US006343398B1

(12) United States Patent
Silverman et al.

(10) Patent No.: US 6,343,398 B1
(45) Date of Patent: Feb. 5, 2002

(54) DRAIN CLEANING APPARATUS WITH FEED CONTROL

(75) Inventors: Arthur A. Silverman, Pittsburgh; Edward Thomas Gaworski, Jr., Coraopolis; Paul Arthur Korvick; Norman J. Borgo, both of Pittsburgh, all of PA (US)

(73) Assignee: General Wire Spring Company, McKees Rocks, PA (US)

( * ) Notice: Subject to any disclaimer, the term of this patent is extended or adjusted under 35 U.S.C. 154(b) by 0 days.

(21) Appl. No.: 09/548,828

(22) Filed: Apr. 13, 2000

(51) Int. Cl.[7] ..... B08B 9/045
(52) U.S. Cl. ..... 15/104.33; 15/104.31
(58) Field of Search ..... 15/104.09, 104.095, 15/104.16, 104.31, 104.33

(56) References Cited

U.S. PATENT DOCUMENTS 2,355,733 A * 8/1944 Johnson
3,268,937 A * 8/1966 Bollinger
3,983,593 A * 10/1976 Naeve
5,901,401 A * 5/1999 Rutkowski et al.
6,076,219 A * 6/2000 Irwin
6,243,905 B1 * 6/2001 Rutkowski

* cited by examiner

*Primary Examiner*—Terrence R. Till
(74) *Attorney, Agent, or Firm*—Carothers & Carothers

(57) ABSTRACT

A drain cleaning apparatus which feeds a drain cleaning snake from a rotating drum through a flexible guide tube and a manually operable cable feed device is provided at the outer end of the guide tube for selectively axially advancing or retracting the snake relative to the cable drum during rotation of the drum. The inner end of the guide tube is supported directly on the cable drum with a bearing for relative rotation between the cable drum and the guide tube. The cable feed device includes a stop protruding from its housing which is positioned for engaging an actuating lever to thereby limit the pivotal extent of the levers displacement away from the housing in order to prevent accidental dislodgement of the drive actuator which is engaged by the lever to operate the cable feed device. This stop is made to be yieldable for thereby permitting the lever to be pivotally displaced with applied force away from the cable feed device housing beyond the normal limited extent against yieldable bias of the stop to thereby permit a passage of an enlarged head portion of the snake through the cable feed device housing or to permit complete removal of the actuator.

7 Claims, 2 Drawing Sheets

DRAIN CLEANING APPARATUS WITH FEED CONTROL

BACKGROUND OF THE INVENTION

The present invention generally pertains to the art of drain cleaning apparatus and more particularly to improvements in directing and feeding the drain cleaning cable snake into a drain or waste line to be cleaned.

The present invention pertains to improvements in portable-motor driven flexible snake drain cleaning apparatus of the type illustrated in U.S. Pat. Nos. 5,901,401 and 6,009,588. These inventions respectively pertain to a feed control arrangement for axially advancing and retracting the cable snake during use of the apparatus and to a flexible guide tube to facilitate an operator in guiding the outlet end of the snake into a drain to be cleaned. The guide tube arrangement for the snake has its inner end directly supported on the frame which supports the machine.

SUMMARY OF THE INVENTION

The drain cleaning apparatus of the present invention includes a frame with a cable snake drum supported on the frame for rotation about a drum axis, wherein the drum has axially spaced front and rear ends and an opening through the front end. A drain cleaning cable snake is coiled in the drum about the drum axis and has an outer end for extending through the opening of the drum into a drain to be cleaned. A drive motor is also supported on the frame for rotating the drum and the cable snake contained therein.

A guide tube is provided for receiving the outer end of the cable snake and the inner end of this guide tube is supported directly on the cable drum itself, as opposed to being independently supported on the frame as taught by the prior art, with a bearing for relative rotation between the cable drum and the guide tube, thereby eliminating the need of an independent frame support for the guide tube which adds additional expense.

The guide tube is flexible between its inner and outer ends for directing the outer end toward a drain to be cleaned and a manually operable cable feed device is provided on the outer end of the guide tube for selectively axially displacing the cable snake relative to the cable drum during rotation of the drum and cable snake about the drum axis.

Improvements are also provided in the cable feed device which includes a housing having an housing axis and a passage axially therethrough for receiving the cable snake. A cable roll drive is supported in the housing in the same fashion and with the same type construction as provided in the prior art for advancing and retracting the rotating cable snake during use of the apparatus.

A drive actuator is supported on the housing for radially displacing the cable snake against the cable roll drive. This drive actuator has radially inner and outer ends and a lever is pivotally mounted on the housing for engaging the outer end and radially displacing the drive actuator against the cable snake.

A stop protrudes from the housing and is positioned for engaging this lever to thereby limit the pivotal extent of its displacement away from the housing for thereby preventing accidental dislodgement of the drive actuator from the housing. However, this stop is yieldable for thereby permitting the lever to be pivotally displaced with applied force away from the housing beyond this limited extent against the yieldable bias of the stop. This permits the drive actuator to be sufficiently radially displaced to permit the passage of an enlarged portion of the cable snake through the housing passage and past the roll drive, and if desired, also permits sufficient clearance to fully remove the drive actuator from the housing for replacement or repair.

The protruding stop may be rendered yieldable by constructing it of yielding material such as spring steel or in the alternative it may be provided in the form of a rigid lever which is spring biased. In one embodiment, this stop lever may include an access cover plate pivotally secured on the housing for providing access to the roll drive.

BRIEF DESCRIPTION OF THE DRAWINGS

Other objects and advantages appear hereinafter in the following description and claims. The drawings show, for the purpose of exemplification, without limiting the invention or appended claims, certain practical embodiments of the present invention wherein:

DETAILED DESCRIPTION OF A PREFERRED EMBODIMENT

Figure 1:
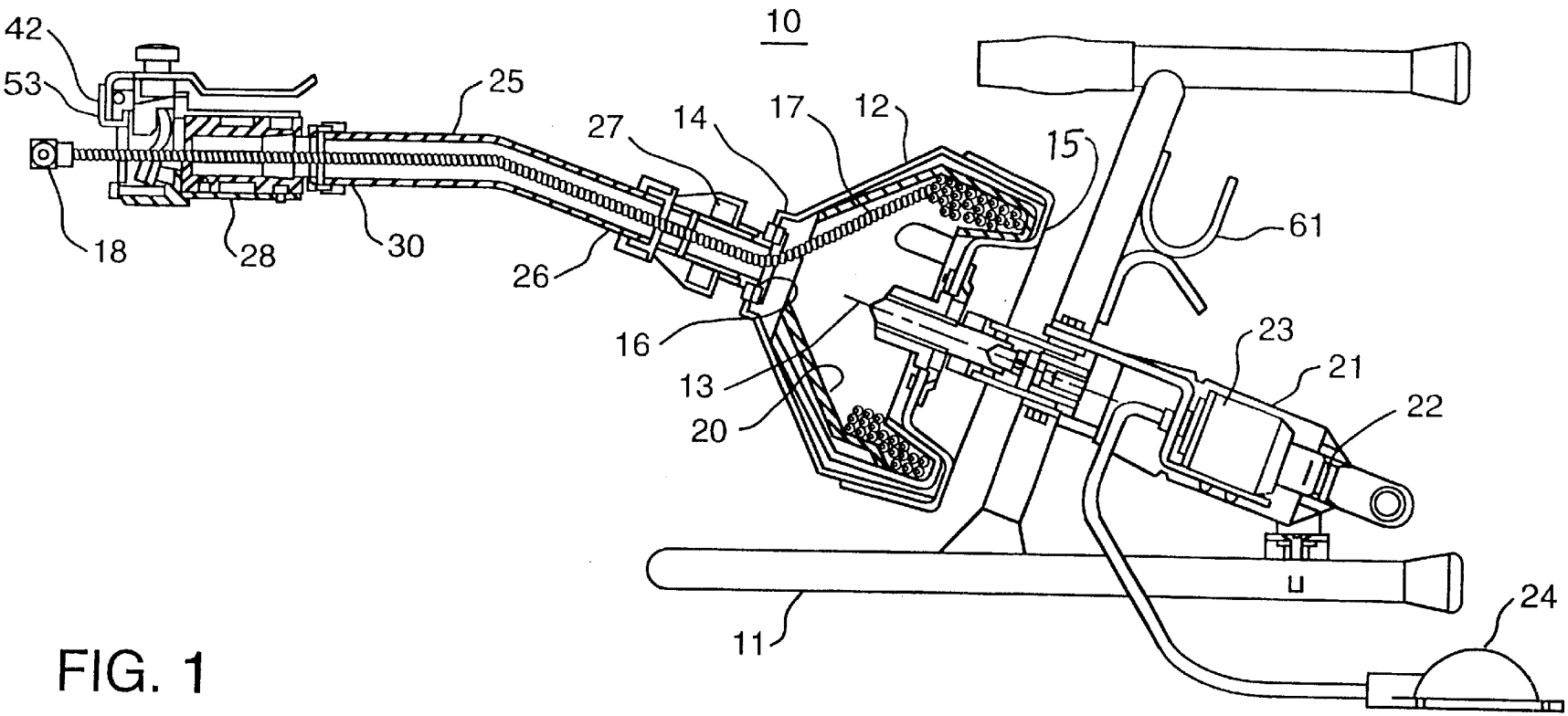
FIG. 1 is a view in side elevation of the drain cleaning apparatus of the present invention with portions thereof illustrated in vertical mid cross section.

Referring to FIG. 1, the drain cleaning apparatus 10 of the present invention includes a frame 11 and a cable drum 12 supported on frame 11 for rotation about the drum axis 13. Drum 12 is provided with axially spaced front and rear ends 14 and 15 respectively with an opening 16 through front end 14.

A drain cleaning cable snake 17 is coiled in drum 12 about axis 13 and has an outer enlarged end 18 for attaching appropriate sewer or drain cleaning apparatus and which extends through opening 16 for extending into a drain (not shown) to be cleaned.

For convenience of changing cable snake 17, cable snake 17 is coiled and contained in an inner plastic cartridge 20, which in and of itself is a common feature of prior art drain cleaning apparatus.

A drive motor 21 is also supported on frame 11 for rotating drum 12 and cable snake 17. Drive motor 21 is here provided in the form of a conventional drill motor and housing which has a variable speed actuating trigger 22 that is variably actuated through the use of a pneumatic piston 23 operated from foot actuated pneumatic pressure pedal 24.

A flexible guide tube 25 is provided for receiving the outer end of cable snake 17 and the inner end 26 of guide tube 25 is supported on the front end 14 of cable drum 12 with or through a guide tube bearing 27 for relative rotation between cable drum 12 and guide tube 25. This bearing 27 is a ball bearing race with thrust bearing capabilities but could be another type of bearing, such as tapered roller, plain or spherical. A manually operable cable feed device 28 is provided on the outer end 30 of flexible guide tube 25 for selectively axially displacing the cable snake relative to cable drum 12 during rotation of the drum and cable about axis 13.

Figure 2:
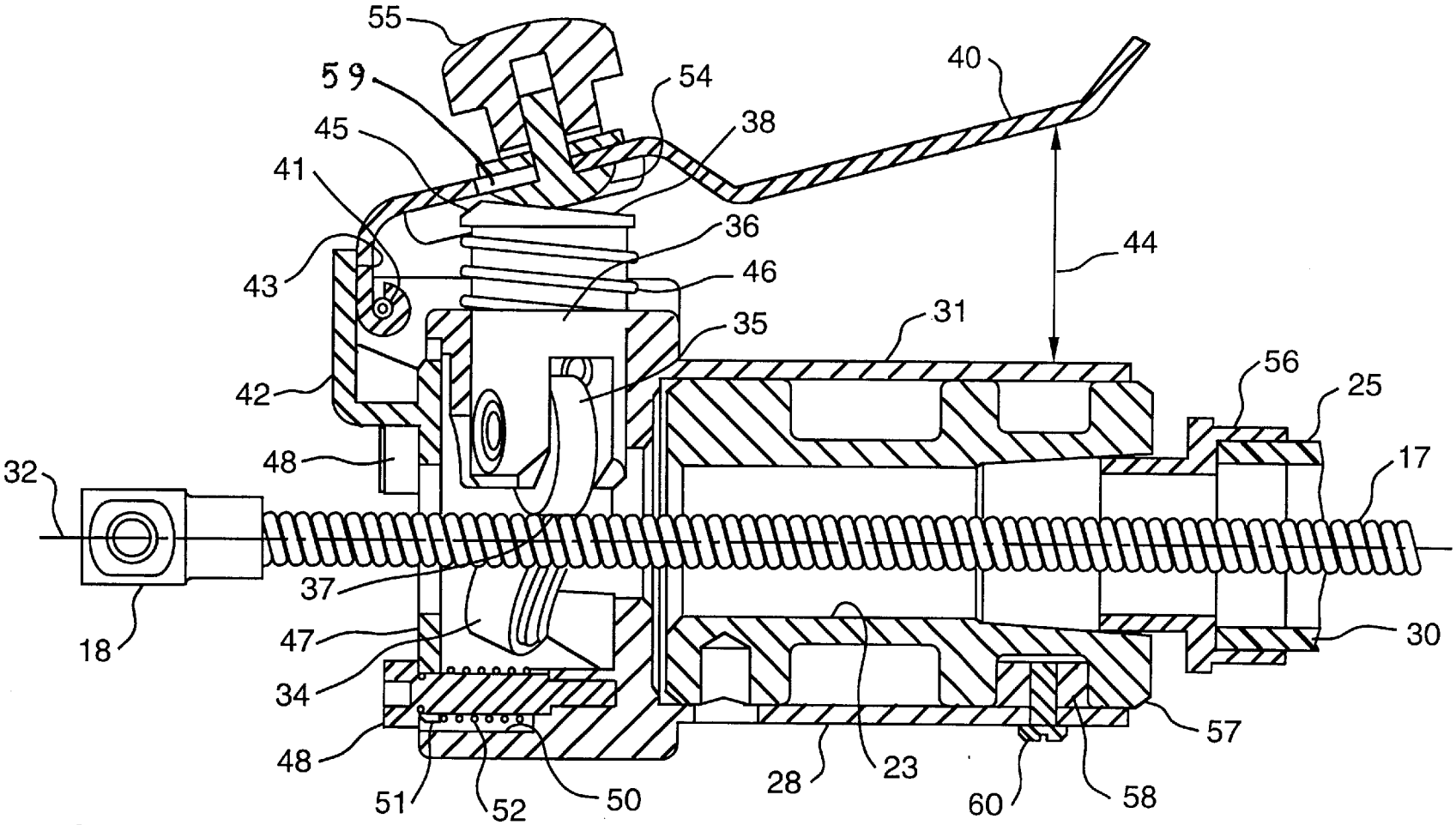
FIG. 2 is an enlarged view of the cable snake cable feed device shown on the forward end of the apparatus of FIG. 1.

The details of cable feed device 28 are best illustrated in the enlarged view of FIG. 2. There is only one minor difference between the structures 28 shown in FIGS. 1 and 2 and this will be detailed hereinafter.

Cable feed device 28 is provided with a housing 31 having a housing axis 32 and a passage 23 extending axially therethrough for receiving snake 17. A snake roll drive 34 is supported on housing 31.

This snake roll drive consists of two skewed bottom rollers of the same construction and operation as shown and described in U.S. Pat. No. 5,901,401 and therefore the details of operation will not be provided. As with other prior art drives of similar construction, when skewed actuator roll 35 radially downward displaces rotating snake 17 against the two skewed bottom rollers of roll drive 34 the rotating cable snake 17 will be advanced either out of or into drum 12, depending upon the direction of rotation of drum 12, together with cable snake 17 coiled therein.

Drive actuator 36 is supported on housing 31 for radially displacing the snake 17 against snake roll drive 34. In FIG. 2, the radially displacement of drive actuator 36 is up and down as illustrated in the figure. Drive actuator 36 is provided with radially inner and outer ends 37 and 38 respectively. Lever 40 is pivotally mounted to housing 31 at pivot 41 whereby lever 40 engages the outer end 38 of drive actuator 36 for radially displacing drive actuator 36 at its radially inner end 37 against snake 17.

A stop 42 protrudes from housing 31 and is positioned for engaging lever 40 at engagement point 43 for thereby limiting the pivotal extent of displacement of lever 40 away from housing 31 as illustrated by dimension 44 for preventing accidental dislodgement of drive actuator 36 from housing 31. Stop 42 is yieldable for permitting lever 40 to be pivotally displaced with applied force away from housing 31 beyond the limited extent 44 against yieldable bias of the stop for thereby permitting sufficient radial displacement of drive actuator 36 to permit passage of enlarged end portion 18 of snake 17 through the housing passage 33 and past roll drive 34. In fact, lever 40 with applied pressure against yieldable stop 42 may be sufficiently displaced beyond limit 44 whereby drive actuator 36 may be completely removed from housing 31 for substitution or repair.

Drive actuator 36 has a cylindrical body which is provided with an enlarged head 45 for engagement of compression spring 46 which continually urges roll drive actuator 36 upwardly by the urging of coil spring 46 outwardly between housing 31 and the underside of the enlarged head 45. This takes up the sloppiness or slack in lever 40 so that it returns to its stopped position as illustrated in the figures and to its limited extent of pivotal movement as indicated by 44.

In FIG. 2, stop 42 is provided in the form of a lever which includes as an integral part thereof access cover 47 which is secured to the front end of housing 31 for providing access to roll drive 34. Access cover 47 is secured to housing 31 with shoulder bolts 48 and yielding clearance 50 is provided at the bottom of housing 31 so that the bottom end 51 may pivot inwardly or to the right under the bias of compression spring 52 for thereby permitting stop 42 to yield under the bias of spring 52 when sufficient applied force is applied to lever 40.

The cable feed device 28 in FIG. 1 is in all respects identical to that illustrated in FIG. 2, except yieldable stop 42 in FIG. 1 is provided in the form of a spring steel arm 53 which is secured to the forward or front end of housing 31.

Lever 40 contacts radially outer end 38 of drive actuator 36 with a rounded protrusion 54, which is in turn threadably secured to lever 40 through a passage as illustrated and threadably engaged with a securing knob 55. Thus, protrusion 54 is not inter-engaged with the outer radial end 38 of actuator 36 and this permits easy and fast removal of actuator 36 from housing 31 when sufficient force is applied to lever 40 against yieldable stop 42.

Guide tube 25 is secured at its outer end 30 to liquid tight conduit fitting 56 which in turn is rigidly secured to housing sleeve 57. Sleeve 57 is coaxially received in housing 31 and therein axially but not radially fixed in position by means of stop 58 which is in turn secured in position by machine screw 60.

A support hook 61 is shown in FIG. 1 as being secured to frame so that the outer end 30 of guide tube 25 may be supported therein to support cable feed device 28 on frame 11 in a compact manner when the machine is not in use.

If it is desired to have depression protrusion 54 to extend out further from the underside of lever 40 in order to further depress actuator 36 radially inward, spacer washers may be inserted between the protrusion head 54 and the lever arm 40 so that the protrusion 54 extends downward to a greater extent as viewed in FIG. 2. This permits regulation of the dimension 44 so that the lever may be custom fit for operation comfort to the hand size of the operator.

Depression protrusion 54 is threadably received in knob 55. Knob 55 may be turned down tightly to clamp depression protrusion 54 in place on lever arm 40. The stem of depression protrusion 54 extends through longitudinal slot 59 provided in lever arm 40 so that knob 55 may be loosened and depression protrusion 54 slid to the left or right along slot 59 and there reclamped at different points opposing the sloped surface of outer end 38. This accordingly provides further fine adjustment as needed to regulate the initial limit of depth of penetration of actuator 36 downwardly into housing 31.

We claim:

1. Drain cleaning apparatus comprising:

a frame;

a cable drum supported on said frame for rotation about a drum axis, said drum having axially spaced front and rear ends and an opening through said front end;

a drain cleaning cable snake coiled in said drum about said axis and having an end for extending through said opening and into a drain to be cleaned;

a drive motor supported on said frame for rotating said drum and cable snake;

a guide tube for receiving said end of said cable snake and having an inner end supported on said cable drum with a bearing for relative rotation between said cable drum and said guide tube and an outer end spaced from said cable drum;

said guide tube being flexible between said inner and outer ends for directing said outer end toward a drain to be cleaned; and a manually operable cable feed device on said outer end of said guide tube for selectively axially displacing said cable snake relative to said cable drum during rotation of said drum and cable snake about said axis.

2. The drain cleaning apparatus of claim 1 wherein said cable feed device includes a housing having a housing axis and a passage axially therethrough for receiving said cable snake, a cable roll drive supported on said housing, a drive actuator supported on said housing for radially displacing said cable snake against said cable roll drive, said drive actuator having radially inner and outer ends, a lever pivotally mounted on said housing for engaging said outer end and radially displacing said drive actuator against said cable snake, and a stop protruding from said housing and positioned for engaging said lever to thereby limit the pivotal extent of its displacement away from said housing for preventing accidental dislodgement of said drive actuator from said housing; and said stop being yieldable for thereby permitting said lever to be pivotally displaced with applied force away from said housing beyond said limited extent against yieldable bias of said stop.

3. A cable feed device for use with a plumbing tool including an elongated flexible snake having a snake axis and means for rotating the snake about said axis, comprising;

a housing having a housing axis and a passage axially therethrough for receiving said snake;

a snake roll drive supported on said housing;

a drive actuator supported on said housing for radially displacing said snake against said snake roll drive;

said drive actuator having radially inner and outer ends;

a lever pivotally mounted on said housing for engaging said outer end and radially displacing said drive actuator against said snake;

a stop protruding from said housing and positioned for engaging said lever to thereby limit the pivotal extent of its displacement away from said housing for preventing accidental dislodgement of said drive actuator from said housing; and said stop being yieldable for permitting said lever to be pivotally displaced with applied force away from said housing beyond said limited extent against yieldable bias of said stop for thereby permitting sufficient radial displacement of said drive actuator to permit passage of an enlarged portion of the snake through said housing passage and past said roll drive.

4. The cable feed device of claim 3 wherein said protruding stop is spring steel.

5. The cable feed device of claim 3 wherein said protruding stop is a spring biased lever.

6. The cable feed device of claim 5 wherein said stop lever includes an access cover plate pivotally secured on said housing for providing access to said roll drive.

7. The cable feed device of claim 3 wherein said lever includes a downwardly protruding depression protrusion for engaging said outer end, said depression protrusion being adjustably positioned in a fixed manner along said lever for engaging said outer end at different preselected positions for thereby regulating the displacement of said drive actuator into said housing.

* * * * *